United States Patent [19]

Kitson et al.

[11] Patent Number: 4,899,989

[45] Date of Patent: Feb. 13, 1990

[54] SAFETY ARRANGEMENT FOR STAIRS

[76] Inventors: Michael J. Kitson; David Williams, both of 21 Ditchbury, Lymington Meadows, Lymington, Hampshire, S041 9FJ, United Kingdom

[21] Appl. No.: 274,285

[22] Filed: Nov. 21, 1988

[30] Foreign Application Priority Data

Nov. 23, 1987 [GB] United Kingdom ..... 8727430

[51] Int. Cl.[4] ..... E04H 17/00

[52] U.S. Cl. ..... 256/1; 52/182; 182/133

[58] Field of Search ..... 256/1; 182/133, 134, 182/135, 189, 36; 248/246; 52/182

[56] References Cited

U.S. PATENT DOCUMENTS

| | | | |
|---|---|---|---|
| 2,727,711 | 12/1955 | Bally | 248/246 |
| 3,968,858 | 7/1976 | Vollan et al. | 182/135 |
| 4,130,177 | 12/1978 | Pandolph | 182/133 X |
| 4,253,287 | 3/1981 | Overmoe | 182/106 X |

FOREIGN PATENT DOCUMENTS 2188344 9/1987 United Kingdom .

*Primary Examiner*—Andrew V. Kundrat

*Attorney, Agent, or Firm*—Fay, Sharpe, Beall, Fagan, Minnich & McKee

[57] ABSTRACT

A safety arrangement for stairs comprises a length of rail secured to a wall parallel to the stairs and a handle which is slidable along the rail if force is applied to the handle in a direction parallel to the longitudinal extent of the rail but is jammed with respect to the rail if force is applied in any other direction. Preferably the handle is a loop formed by rubber covered reinforcement and the handle is a loop formed by rubber covered reinforcement and the handle has a neck portion leading to a head portion, the neck portion extending through a slot into a box section of the rail which contains the head portion.

6 Claims, 3 Drawing Sheets

SAFETY ARRANGEMENT FOR STAIRS

The invention relates to a safety arrangement for stairs.

Stairs present a considerable problem to aged, infirm and disabled persons and accidents frequently occur from persons tripping or collapsing on stairs and falling down the stairs and injuring themselves. Even where handrails are provided accidents may still occur since persons, when ascending or descending, have to release a grip on the handrail and slide their hands upwardly or downwardly before again taking a grip so that the hands can be used for support.

According to the invention there is provided a safety arrangement for stairs comprising an elongate rail and a handle engaged on the rail and longitudinally slidable therealong, the engagement of the handle on the rail being such that any force applied to the handle, other than in a direction parallel to the longitudinal extent of the rail, causes jamming of the handle with respect to the rail thereby to prevent sliding movement of the handle along the rail.

Preferably the rail has a portion thereof with four walls defining a box section with a longitudinally extending slot in one of the walls, and the handle has a gripping portion to be gripped by the user, a narrow neck portion integral with the gripping portion and to extend through the slot in said one of the walls and a head portion integral with the neck portion, contained within the box section and of a width greater than the width of the slot. The head portion can be formed of or coated with high friction material such as rubber and preferably the handle comprises a skeleton of reinforcing material with a covering of rubber moulded thereover.

Advantageously a second of the walls of the box section, which second wall extends parallel to said one wall, extends laterally outwardly from the box section to form fixing flanges with apertures therein to receive fixing screws whereby the rail can be secured to a wall alongside a flight of stairs. The fixing flanges and/or the second wall of the box section may have longitudinally extending grooves therein to receive alignment pins whereby a length of the rail can be maintained in alignment with a further length of rail.

Preferably the gripping portion is formed as a closed loop and is big enough to be grasped by both hands of the user.

Preferably the rail is formed as an anodised aluminum extrusion.

A length of rail, provided with end stops at its ends, can have a plurality of handles engaged therewith so that the safety arrangement is usable by more than one user.

Preferably the rail is provided in two metre lengths. Where bends or half landings are provided in flights of stairs, whereby the flights of stairs are effectively provided in sub-flights, a separate safety arrangement may be provided for each sub-flight so that a user can move from one of the safety arrangements to a successive one.

The invention is diagrammatically illustrated by way of example in the accompanying drawings in which.

Figure 1:
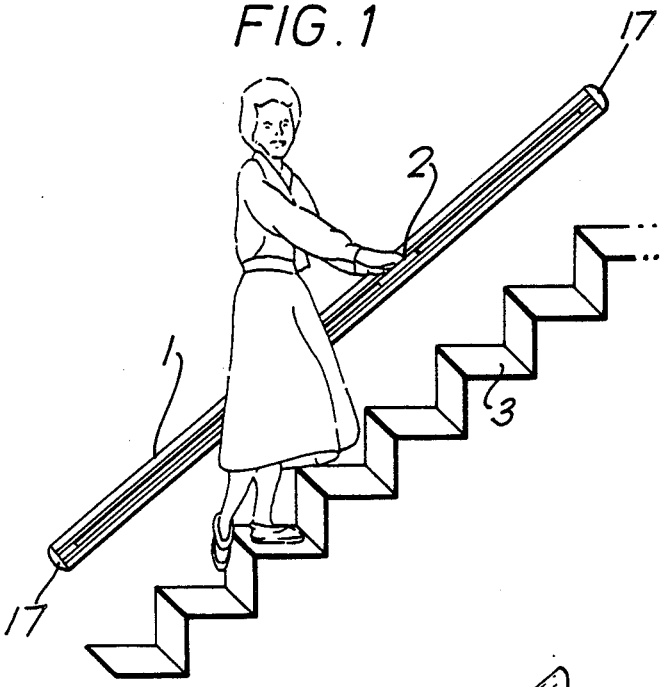
FIG. 1 is a perspective view of a safety arrangement according to the invention in use.

Referring to the drawings, a stair safety arrangement comprises a length of rail 1 and a handle 2. The length of rail 1 is secured to a wall alongside a flight of stairs 3 at a suitable height thereabove, for example one metre, and extending parallel to the overall slope of the stairs.

Figure 2:
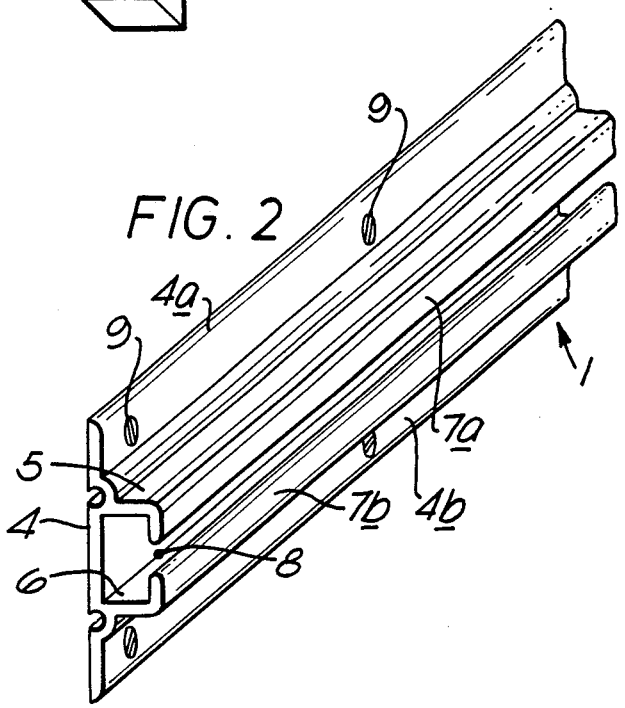
FIG. 2 is a perspective view of part of a length of rail of a safety arrangement according to the invention.
Figure 3:
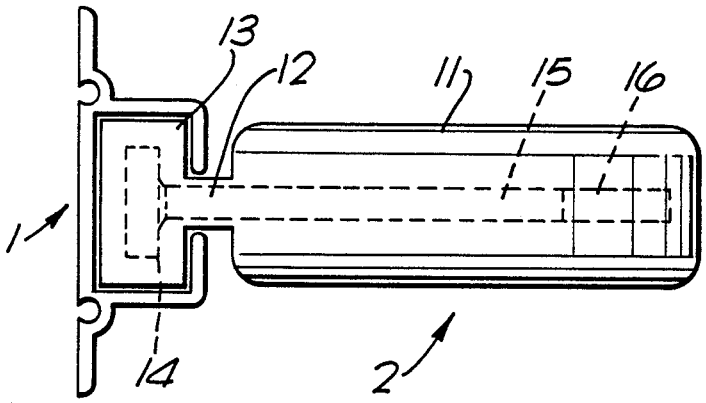
FIG. 3 is an end view of a safety arrangement according to the invention showing a handle engaged in a rail.
Figure 5:
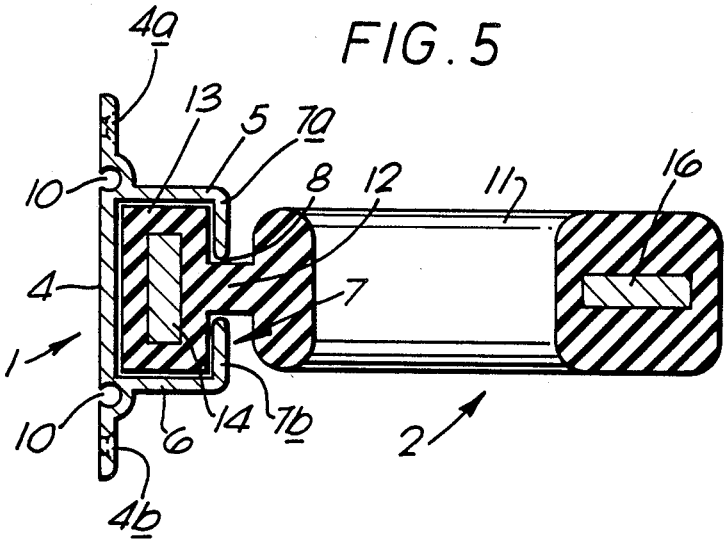
FIG. 5 is a sectional view of the handle taken on line V—V of FIG. 4 and also showing the rail sectioned.

As shown in FIGS. 2, 3 and 5, the rail 1 comprises a box section having a base wall 4, side walls 5 and 6 and an outer wall 7 formed by flanges *7a* and *7b*, the flanges *7a* and *7b* lying in the same plane and being spaced apart so as to form a longitudinally extending slot 8 therebetween. The base wall 4 is extended by side flanges *4a* and *4b* in which countersunk apertures 9 are provided for receiving fixing screws. Elongate grooves 10 are provided at the junction of the base wall 4 with the side walls 5 and 6 and the flanges *4a* and *4b*, which grooves 10 can receive alignment pins whereby a length of rail 1 will be held in longitudinal alignment with a further length of rail 1.

Figure 4:
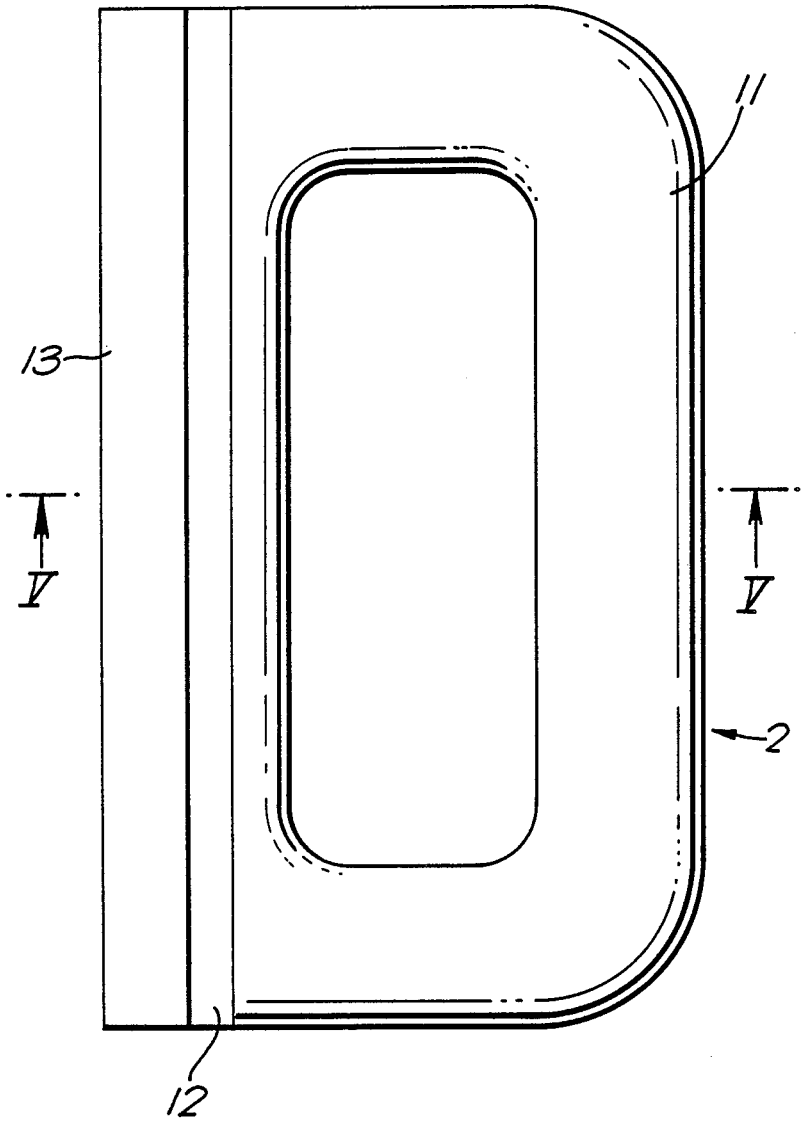
FIG. 4 is a plan view of the handle of FIG. 3.

As shown in FIGS. 3, 4 and 5, the handle 2 comprises a gripping portion 11 to be gripped by the user, a neck portion 12 to extend through the slot 8 in the rail 1 and a head portion 13 within the box section of the rail 1. As shown in FIGS. 3 and 5, the handle 2 has a skeleton of reinforcing material, preferably steel, comprising a bar 14 within the head 13, side bars 15 (only one of which is visible) and an outer bar 16, the bars 14, 15 and 16 being welded together in a closed loop. High friction material such as rubber is moulded onto the reinforcing bars 14, 15, 16 to form a shape such that the head 13 practically fills the box section of the rail 1, the neck 12 is a sliding fit in the slot 8 and the gripping portion 11 is formed as a loop which can comfortably be grasped by at least one and preferably both hands of a user.

End stops 17 are provided in the box section at opposite ends of the rail 1 to prevent the handle 2 from falling out.

The manner of use can be seen from FIG. 1. The user grasps the gripping portion 11 with both hands and, assuming that the stairs are to be ascended, slides the handle 2 longitudinally upwardly along the rail 1, for example for half a metre, to a position as far forward as she can comfortably reach. Downward pressure is then applied to the gripping portion 11 and such downward pressure will cause the head portion 13 to jam within the box section of the rail 1 thereby preventing sliding movement of the handle 2 with respect to the rail 1. The user can thus pull herself upwardly towards the handle 2 and move her feet upwardly on the treads of the stairs 3 until adjacent to the position at which the handle is located. The movement can then be repeated until the user has ascended the full flight of the stairs. If stairs are to be descended then the procedure is similar in that the user pushes the handle in the direction of desired movement and then applies a downward force to the handle to lock it in position with respect to the rail before moving to a position adjacent the handle.

It will be appreciated that force applied to the handle 2 in any direction except exactly parallel to the longitudinal extent of the rail will cause the head portion 3 to jam in the box section of the rail 1. Thus an upward force as well as a downward force, a twisting force or a force directed directly outwardly from the wall will all cause jamming and locking of the handle with respect to the rail thereby to provide a firm support on which the user can depend. Trials have shown that the safety arrangement of the invention is highly effective and beneficial to the aged, the infirm, the blind, persons convalescing, expectant mothers and young children. In use the risk and fear of using stairs has been found to be greatly reduced. Not only can it be effective in preventing accidents but it can allow persons to negotiate stairs who might otherwise not be able to negotiate stairs due to insufficient strength in the legs since it allows the arms to be used much more effectively to assist in climbing stairs.

What is claimed is:

1. A safety arrangement for stairs, said safety arrangement comprising an elongate rail and a handle engaged on said rail and longitudinally slidable therealong, the engagement of said handle on said rail being such that any force applied to said handle other than in a direction parallel to the longitudinal extent of said rail causes jamming of said handle with respect to said rail thereby to prevent sliding movement of said handle along said rail, wherein said head portion is coated with high friction material.

2. A safety arrangement as claimed in claim 1, wherein said high friction material is rubber.

3. A safety arrangement for stairs, said safety arrangement comprising an elongate rail and a handle engaged on said rail and longitudinally slidable therealong, the engagement of said handle on said rail being such that any force applied to said handle other than in a direction parallel to the longitudinal extent of said rail causes jamming of said handle with respect to said rail thereby to prevent sliding movement of said handle along said rail, wherein said handle comprises a skeleton of reinforcing material and a covering of rubber moulded over said skeleton.

4. A safety arrangement for stairs, said safety arrangement comprising an elongate rail and a handle engaged on said rail and longitudinally slidable therealong, the engagement of said handle on said rail being such that any force applied to said handle other than in a direction parallel to the longitudinal extent of said rail causes jamming of said handle with respect to said rail thereby to prevent sliding movement of said handle along said rail, said rail having a portion thereof having four walls defining a box section with a longitudinally extending slot provided in one of said walls, said handle having a gripping portion to be gripped by the user, a narrow neck portion integral with the gripping portion and extending through said slot in said one of the walls and a head portion integral with said neck portion and contained within said box section, said head portion having a width greater than the width of said slot and a second of said walls of said box section, which said second wall extends parallel to said one of said walls, extending laterally outwardly from said box section to form fixing flanges and said fixing flanges being formed with apertures therein to receive fixing screws whereby said rail can be secured to a wall alongside a flight of stairs.

5. A safety arrangement as claimed in claim 4, wherein said rail, at junctions of said fixing flanges and said second of said walls of said box section, is formed to have longitudinally extending grooves therein to receive alignment pins whereby a length of said rail can be maintained in alignment with a further length of said rail.

6. A safety arrangement as claimed in claim 4 wherein said gripping portion is formed as a closed loop and is big enough to be grasped by both hands of the user.

* * * * *